US005155958A

United States Patent [19]

Huff

[11] Patent Number: 5,155,958

[45] Date of Patent: Oct. 20, 1992

[54] FASTENING AND SUPPORT SYSTEM FOR ARCHITECTURAL PANELS

[76] Inventor: James C. Huff, 6860 N. Broadway, Ste. C, Denver, Colo. 80221

[21] Appl. No.: 778,408

[22] Filed: Oct. 17, 1991

[51] Int. Cl.[5] ..... E04H 1/00

[52] U.S. Cl. ..... 52/235; 52/398; 52/509

[58] Field of Search ..... 52/235, 397-399, 52/606, 509, 508, 512

[56] References Cited

U.S. PATENT DOCUMENTS

| | | | |
|---|---|---|---|
| 4,021,987 | 5/1977 | Schnebel | 52/235 X |
| 4,338,753 | 7/1982 | Janke | 52/398 X |
| 4,483,122 | 11/1984 | Crandell | 52/235 X |
| 4,650,702 | 3/1987 | Whitmyer | 52/235 X |

*Primary Examiner*—Richard E. Chilcot, Jr.
*Assistant Examiner*—Beth A. Auby
*Attorney, Agent, or Firm*—Dorr, Carson, Sloan & Peterson

[57] ABSTRACT

A fastening system is used to attach architectural panels to a building structure in which three panel brackets are attached along the bottom and side edges of the panel. These panel brackets each have a front face adapted to extend along the rear surface of the panel adjacent to one of the panel's peripheral edges; a panel-gripping flange extending from the front face suitable for insertion into a groove extending along the peripheral edge of the panel; and a channel with an opening extending parallel to the peripheral edge of the panel. A top panel bracket is also attached along the top edge of the panel, which has a front face and a panel-gripping flange as before, and which further has a support member to secure the top panel bracket to the building structure; and a vertical flange extending upward at a predetermined spacing from the building structure. In addition, vertical mounting brackets are secured to the building structure in a vertical orientation, with two opposing flanges extending laterally outward at a predetermined distance from the building structure. The system is assembled by inserting the vertical flange extending upward from the top panel bracket immediately below into to the channel extending along the bottom panel bracket, and by inserting the vetical mounting bracket flanges into the channels extending along the side panel brackets.

15 Claims, 5 Drawing Sheets

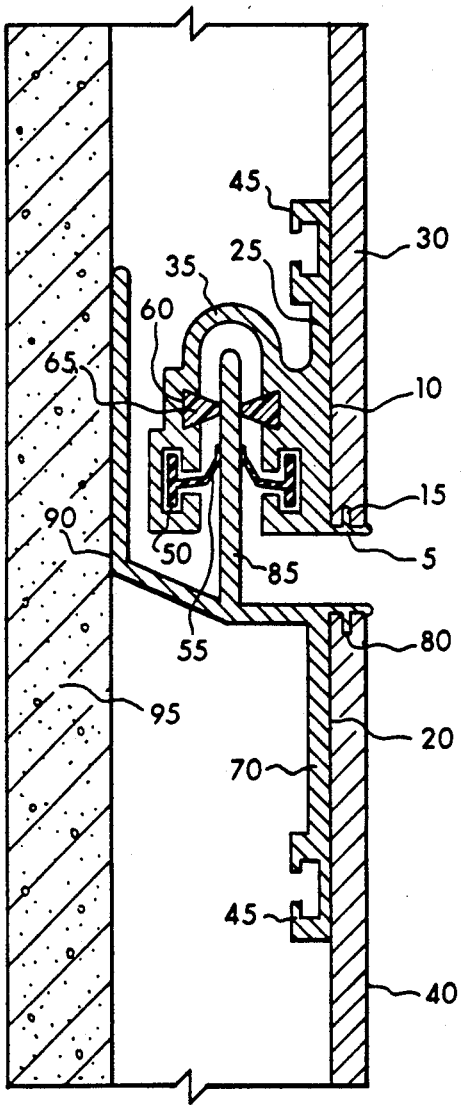
Fig. 1
Fig. 2
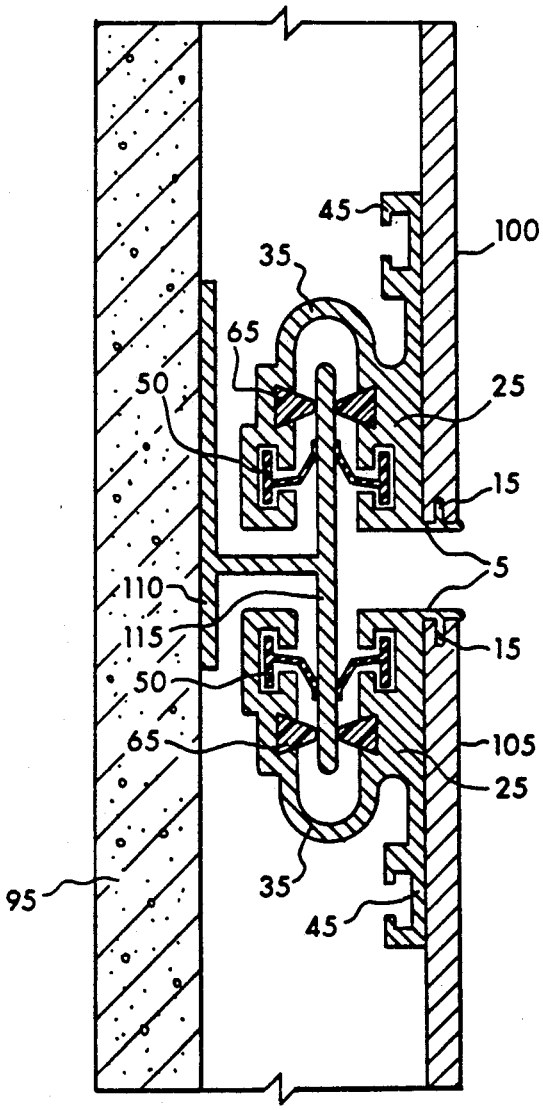

FASTENING AND SUPPORT SYSTEM FOR ARCHITECTURAL PANELS

BACKGROUND OF THE INVENTION

1. Field Of The Invention

This invention relates generally to the field of building construction and more particularly to devices used to support and fasten architectural panels together to form the exterior of a building.

2. Brief Description Of The Prior Art

Complex fastening and support systems used to connect exterior aluminum facia panels together to form the exterior of commercial buildings are old and well-known in the art. As it is extremely expensive to construct commercial office buildings from brick, and wood is unsuitable for this type of construction, the commercial industry has turned to the practice of employing large sheets of architectural panels made of aluminum, steel, masonry or even large glass panels to form the exterior surface of a building. Because of this extensive utilization of exterior panels, a variety of different types of connecting brackets have been developed over the years to serve as means for fastening these panels together while also forming a sturdy support structure therefor. However, the fastening systems presently known in the art have many inherent problems or shortcomings.

Some of the prior art problems are as follows. First, the fastening systems presently known in the art tend to be overly complex in structure and composed of many small pieces susceptible to easy loss or damage. Secondly, those systems presently known in the art are not particularly effective. The seams and joints tend to leak when exposed to rain. This is such a major problem that the corners where four panels meet usually form a square void which must be filled with a caulking material, such as structural silicone. Caulking has a limited effectiveness due to its very nature, is very time consuming to apply and is not a very reliable sealant especially in a metal to metal joint wherein the metal components expand and contract in response to weather or other atmospheric conditions. These panels are also exposed to wind velocities which shake the panels and tend to break the caulk joints/seals no matter how carefully they have been applied thereby ruining their effectiveness in a sealant capacity.

Another major problem with the prior known fastening systems is the manner in which these panels must be applied to the exterior of the building. Namely, when the prior art fastening systems are employed to secure panels to the exterior of a building, the panels must be installed in a progressive sequence—i.e., bottom-to-top and right-to-left (or vice-versa) sequence, along each face of the building. If a panel in the middle of a wall is incorrectly installed or subsequently damaged, all of the panels from the edge of the wall back to the damaged panel must be removed in reverse order in order to replace the single damaged panel. This is not only a waste of construction time but it inherently exposes the undamaged panels to damage themselves by having to remove them once set.

The fastening system marketed by Architectural Product, Inc. of Willoughby, Ohio, is an example of the prior art widely used in this field. A typical bracket is comprised of a modified T-shaped bracket wherein the side of the T exposed to the exterior is very short in width and provided with a vertical flange that seats within a groove provided along the edges of the architectural panel. The straight of the T rests against the length of the panel with the end thereof either resting freely against said panel or provided with: a sealant along the edge thereof. The other side of the T extends back to form a connection with a bracket that has been bolted to the exterior wall of the building. The point at which the T attaches to this bracket may comprise a channel connection which is also provided with a sealant. The gaps (usually on the order of ½ inch) extending along the joints between each adjacent pair of panels are filled with additional sealant and a backer rod therefor. It should be noted that both the horizontal and vertical joints have the presence of these large gaps between every pair of adjacent panels when utilizing this panel fastening system. In addition, these gaps form square voids at each panel corner which are especially difficult to fill with sealant so as to prevent leakage of water behind the panels. An alternate fastening system employs a complicated U-shaped bracket that is attached to a main support bracket which is in turn supported by a third bracket fastened to the stud wall. In this instance, three different brackets must be interconnected to support the exterior wall panels. Gaskets, urethane sponge weeps and sealant are provided within the bracket-to-bracket connections to try to make these connections fluid tight. However, owing to the fact that numerous connections are made, and that the brackets must be carefully assembled together, there is a tendency for joint leakage to occur and for the brackets to be susceptible to breakage when exposed to external weather conditions.

The closest prior art is the "ALUCOBOND" wall system marketed by Elward, Inc. of Lakewood, Colo. In this system, the bracket extending along the bottom edge of each panel has a modified T shape, with the short side of the T provided with a flange that fits within the groove provided along the bottom edge of the architectural panel. The straight of the T fits flush against said back of the panel adjacent to the bottom edge. The other side of the T is provided with an inverted U-shaped channel which accommodates a vertical member extending upwardly from the bracket extending along the top edge of the panel below which has been secured to the wall. The inverted U-shaped channel has been provided with two opposed wipers that form a seal with a surface of the vertical member against the elements. The inverted U-shaped channel is not found on the brackets used to hold the lateral edges of the panels. Instead, a complicated two-part clip forms the vertical joint between adjacent panels.

The present invention provides a fastening system and bracket that alleviates the above mentioned problems by using brackets with inverted U-shaped channels on the bottom and both lateral edges of the panels. In the present design, the panels must be installed from bottom-to-top but not necessarily in any particular lateral order. This simplifies the removal of a: damaged panel. It also allows panel installation to be initiated in the middle of a wall and to proceed in both lateral directions at once. By permitting this flexibility in the installation procedure, two different crews can be working from the middle of the wall out thereby adding to the cost efficiency of the entire installation procedure. This not only allows faster installation, but it also simplifies the accurate placement of panel edges to match doorways, windows and wall corners etc. In addition, the brackets have been designed such that it is possible to remove a single damaged panel from a wall without requiring the removal of laterally adjacent panels. In addition, a pair of plastic guides positioned above the flexible wipers within the U-shaped channel offers better structural support for the panels, which result in a more accurate alignment of the panels and less movement of the panel assemblies when exposed to high winds. Furthermore, the track provided in the top of the straight of the T-shaped bracket can be used to secure a piece of angle iron to form accurate corners, and/or to secure a stiffener across the back of the panel.

SUMMARY OF THE INVENTION

The present invention provides a fastening system to attach architectural panels to a building structure in which three panel brackets are attached along the bottom and side edges of the panel. These panel brackets each have a front face adapted to extend along the rear surface of the panel adjacent to one of the panel's peripheral edges; a panel-gripping flange extending from the front face suitable for insertion into a groove extending along the peripheral edge of the panel; and a channel with an opening extending parallel to the peripheral edge of the panel. A top panel bracket is also attached along the top edge of the panel, which has a front face and a panel-gripping flange as before, and which further has a support member to secure the top panel bracket to the building structure; and a vertical flange extending upward at a predetermined spacing from the building structure. In addition, vertical mounting brackets are secured to the building structure in a vertical orientation, with two opposing flanges extending laterally outward at a predetermined distance from the building structure. The system is assembled by inserting the vertical flange extending upward from the top panel bracket immediately below into to the channel extending along the bottom panel bracket, and by inserting the vertical mounting bracket flanges into the channels extending along the side panel brackets. In the preferred embodiment, a pair of opposed flexible wipers extend along the interior of each panel bracket channel and are inwardly deflected as the flange is inserted into the channel. In addition, a pair of opposed guides extend along the interior of the channel guide insertion of the flange into the channel.

The following advantages are afforded by this new invention. First, the panels need not be installed in any particular lateral order (although bottom to top installation is still required). This new fastening system allows for a great flexibility regarding the installation of said architectural panels and greatly simplifies the removal and replacement of a damaged panel once the project has been completed.

Second, the present system employs both dual wipers and plastic guides that serve as an effective sealant system against the leakage of any moisture into the wall structure. This system offers four sealing barriers (the two wipers and the two plastic guides) past which any moisture would have to travel before entering the wall system. This has proven to be a very effective moisture barrier. Likewise, by providing these multiple barriers there is no need to provide the gap created between panels with the traditional sealant, i.e. caulk etc., which has been already proven to be an ineffective sealant in this type of construction.

Thirdly, the plastic guides and dual wiper system of the present invention enhance the flexibility of the exterior wall panel system in that any shaking of the panels by the wind etc. can be better accommodated without sacrificing the tightness of these jointed connections. The plastic guides and wipers are inherently flexible such that they maintain contact with the adjacent mounting bracket structure at all times.

Lastly, the bracket has been provided with individual tracks on the ends thereof which: (1) add to the structural integrity of the overall bracket due to the actual presence of additional material; (2) allow angle iron to be mounted thereto to aid in the forming of tight corner fittings, etc.; and (3) can be used to accommodate the heads of bolts employed to secure a brace or stiffener rod across the rear face of the architectural panel for additional structural support.

BRIEF DESCRIPTION OF THE DRAWINGS

FIG. 1 is a vertical cross-sectional view showing two brackets fastened together to form a horizontal joint between two architectural panels.

FIG. 2 is a horizontal cross-sectional view showing two brackets secured together about a support structure to form a vertical joint between two adjacent architectural panels.

DETAILED DESCRIPTION OF THE INVENTION

Figure 3:
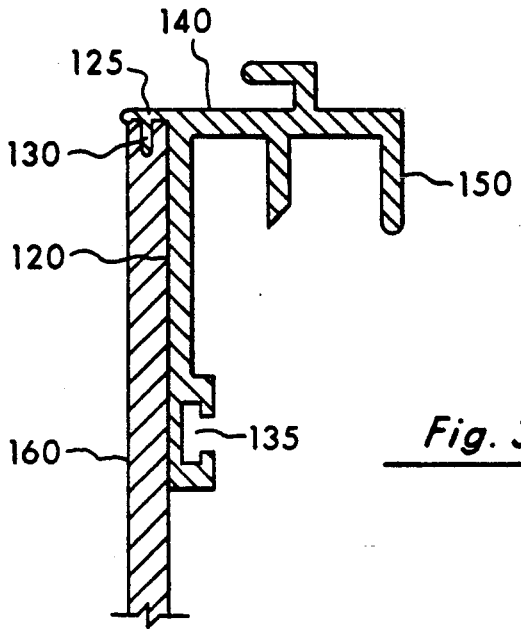
FIG. 3 is a vertical cross-sectional view of the type of bracket utilized at the top of the building to fasten the uppermost architectural panel to the building and to secure flashings to the system.

FIG. 1 provides a vertical cross-sectional view of a typical horizontal joint between two adjacent architectural panels 30 and 40. A corresponding horizontal cross-sectional view of the a typical vertical joint between two adjacent architectural panels 100 and 105 is provided in FIG. 2. The architectural panels are typically made of a metal (e.g. aluminum) or a metal composite structure having a rectangular or square shape of predetermined dimensions. By convention, these architectural panels have a groove extending along their peripheral edges to facilitate mounting and structural support.

In the preferred embodiment, two types of panel bracket are predominately used. As shown in FIG. 1, a top panel bracket 70 is fastened along the top edge of each architectural panel 40. The top panel bracket 70 has a front face 10 which seats against the rear surface of the panel 40 adjacent to its top edge. A sealant and/or adhesive can be applied between the rear surface of the panel 40 and the front face 10 of the top panel bracket 70, if so desired. A panel-gripping flange 80 extends forward from said front face 20 and is adapted for insertion into the groove extending along the top edge of the panel 40. A support member 90, typically in the form of an upwardly extending flange as shown in FIG. 1, permits the top panel bracket to be bolted or otherwise secured to the building structure 95. A second substantially vertical flange 85 extends upward from the top panel bracket 70 at a predetermined spacing in front of said building structure. The top panel bracket 70 also has a track 45 extending along its rear face parallel to the top edge of panel 40. As will be discussed at greater length below, this track 45 can be employed to secure one end of a stiffener or brace extending across the back of the panel for additional structural support.

The second type of panel bracket 25 shown in FIG. 1 is secured along the bottom edge of the architectural panel 30. This bottom panel bracket 25 again has a front face 10 adapted to extend along the rear surface of the panel 30 adjacent to its bottom edge, and a panel-gripping flange 5 extending forward from the front face 10 which is inserted into the groove 15 extending along the bottom edge of the panel. However, unlike the top panel bracket 70, the bottom panel bracket 25 also has an inverted U-shaped channel 35 with an opening extending parallel and adjacent to the bottom edge of the panel 30. This channel 35 is adapted to receive the vertical flange 85 extending upward from the top panel bracket 70 of the panel 40 below, as shown in FIG. 1.

The channel 35 has a first set of two opposed, internal embedded grooves 50 used to support a pair of opposed flexible wipers 55. These wipers 55 are made of a flexible material, i.e., rubber, such that when the bottom panel bracket 2 is attached to the top panel bracket 70 below (i.e., when the vertical flange 85 of the top panel bracket below 70 enters the channel 35) the wipers 55 inwardly deflect to securely fasten the bottom panel bracket 25 to top panel bracket 70. In addition to the first set of opposed embedded grooves 50, the channel 35 has also been provided with a second set of opposed, internal, embedded grooves 60 supporting a pair of opposed plastic guides 65 positioned within the channel to the interior of rubber wipers 55. These plastic guides 65 serve to further stabilize the connection made between the channel 35 of said bottom panel bracket 25 and said top panel bracket 70 below such that a tight, weatherproof connection is achieved. The combination of the two opposed wipers 55 and the two opposed plastic guides 65 form a strong and secure joint between panels while also enhancing the sealing of the interior of the wall structure against the outside elements.

FIG. 2 discloses a vertical joint made between two laterally adjacent architectural panels 100 and 105 which is comprised of two panel brackets 25 secured to a vertical support member 110 (e.g. an I-shaped stud 110) fastened to the building structure 95. As shown in this figure, two architectural panels 100 and 105 are positioned side by side with each panel individually attached to a panel bracket 25. In the preferred embodiment, the structure of these side panel brackets are substantially the same as the bottom panel bracket 25 previously discussed and shown in FIG. 1. These elements have thus been labeled identically as is clear in the drawings. Each of the side panel brackets 25 has a front face which seats against the rear surface of the panel adjacent to one of the side edges of the panel. A panel-gripping flange 5 extends forward from the front face and inserts into the groove 15 extending along the side edge of said panel. An inverted U-shaped channel 35 extends vertically with an opening parallel and adjacent to the side edge of the architectural panel 100 or 105.

A series of vertical mounting brackets 110 are secured to the building structure 95 in a substantially vertical orientation such that the horizontal distance between adjacent vertical mounting brackets 110 is approximately equal to the width of the architectural panel 110 or 105. Each vertical mounting bracket 110 has two opposing flanges 115 extending laterally outward from the bracket 110 at a predetermined spacing in front of the building structure 95. In the preferred embodiment, the vertical mounting brackets 110 have a substantially I-shaped cross-section, as shown in FIG. 2. The vertical joint between panels 100 and 105 is assembled by inserting one of these vertical mounting bracket flanges 115 into the channel 35 of each side panel bracket 25 as shown in FIG. 2.

FIG. 3 discloses the type of bracket utilized at the top of the building to fasten the uppermost architectural wall panel to the exterior of the building. This specially shaped panel bracket 140 is comprised of a modified L-shape with a front face 120 (or vertical side of the L shape) adapted to abut the rear surface of the architectural panel 160, and a panel-gripping flange 125 designed to hold the standard groove 130 extending along the top edge of the uppermost architectural panel 160. As with the other types of panel brackets previously discussed, a sealant or adhesive is also typically provided between the front face 120 of the panel bracket 140 and the rear surface of the architectural panel 160. Positioned on the horizontal segment of the L is a support flange 150 extending downwardly as shown in FIG. 3. This flange serves as the means for fastening the bracket 140 to the building structure. The straight of this bracket has also been provided with a track 135 similar to the tracks 145 provided on the other types of panel brackets.

Figure 4:
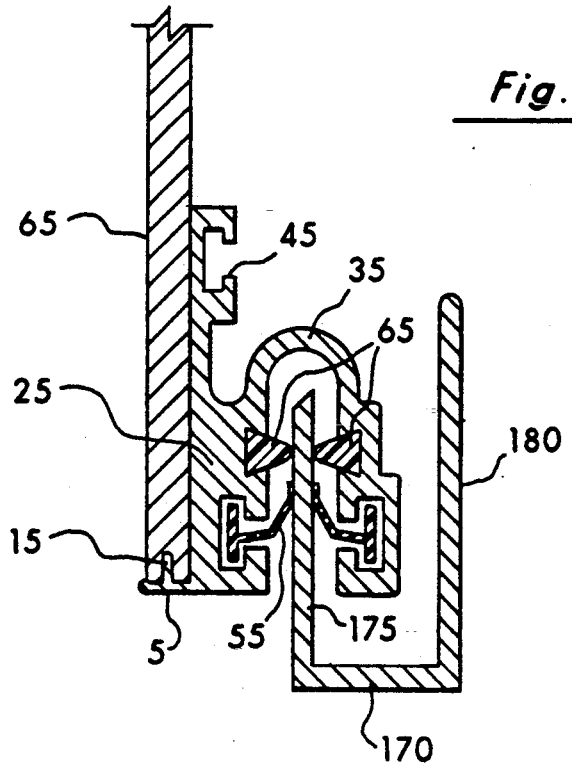
FIG. 4 is a vertical cross-sectional view of the type of bracket employed at the base of the wall structure of the building or a lower edge joint to fasten the lowermost architectural panel.

FIG. 4 discloses the type of support bracket 180 employed at the base of the wall structure of the building to fasten the lowermost architectural panel 65 to the lowermost edge of the building. This type of bracket connection can also form the connection between the top of a door jam or window opening or anywhere where an architectural panel must be joined to the building to form a lowermost edge. Additionally, a similar support bracket is employed at the lateral edges of the wall structure to fasten the lateral edge of an architectural panel 65 to a vertical edge of the building. As shown in FIG. 4, a bottom panel bracket 35 is fastened to the bottom edge of the lowermost architectural panel 65 as previously described, to form a bottom edge joint on a building. This bottom panel bracket 35 is of the same configuration as that disclosed in FIG. 1, including an inverted channel 35 having resilient wipers 55 and plastic guides 65. The connection between the architectural panel and the structural wall of the building is made via a U-shaped support bracket 170 wherein one side of this bracket 170 is securely positioned within the inverted channel 35 as shown and the other side 180 of the bracket 170 is securely fastened to the building structure by screws, bolts, or other conventional fastening means.

Figure 5:
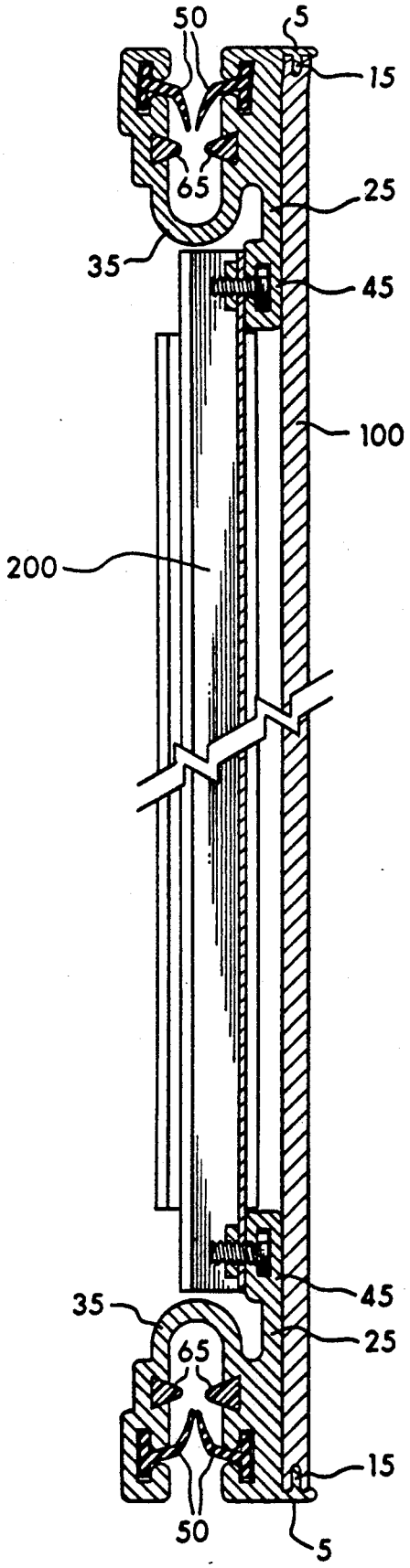
FIG. 5 is a horizontal cross-sectional view of an architectural panel with two brackets along the lateral edges of the panel and a stiffening member extending between the edge brackets.

As stated above, each of the four panel brackets 70 and 25 (top, bottom, and two sides) has been provided with a track 45 with an opening extending along the rear face of the panel bracket parallel to the respective edge of the panel. These tracks are intended to fill two purposes. First, as shown in FIG. 5, the cross-section of the tracks is designed to permit the head of a bolt 210 to be slidably inserted therein. A stiffener or brace 200 can thereby be secured across the back of an architectural panel 100 between two panel brackets 35 by means of bolts 210 and nuts 220. The stiffener adds to the rigidity and structural integrity of the overall panel bracket assembly.

Figure 6:
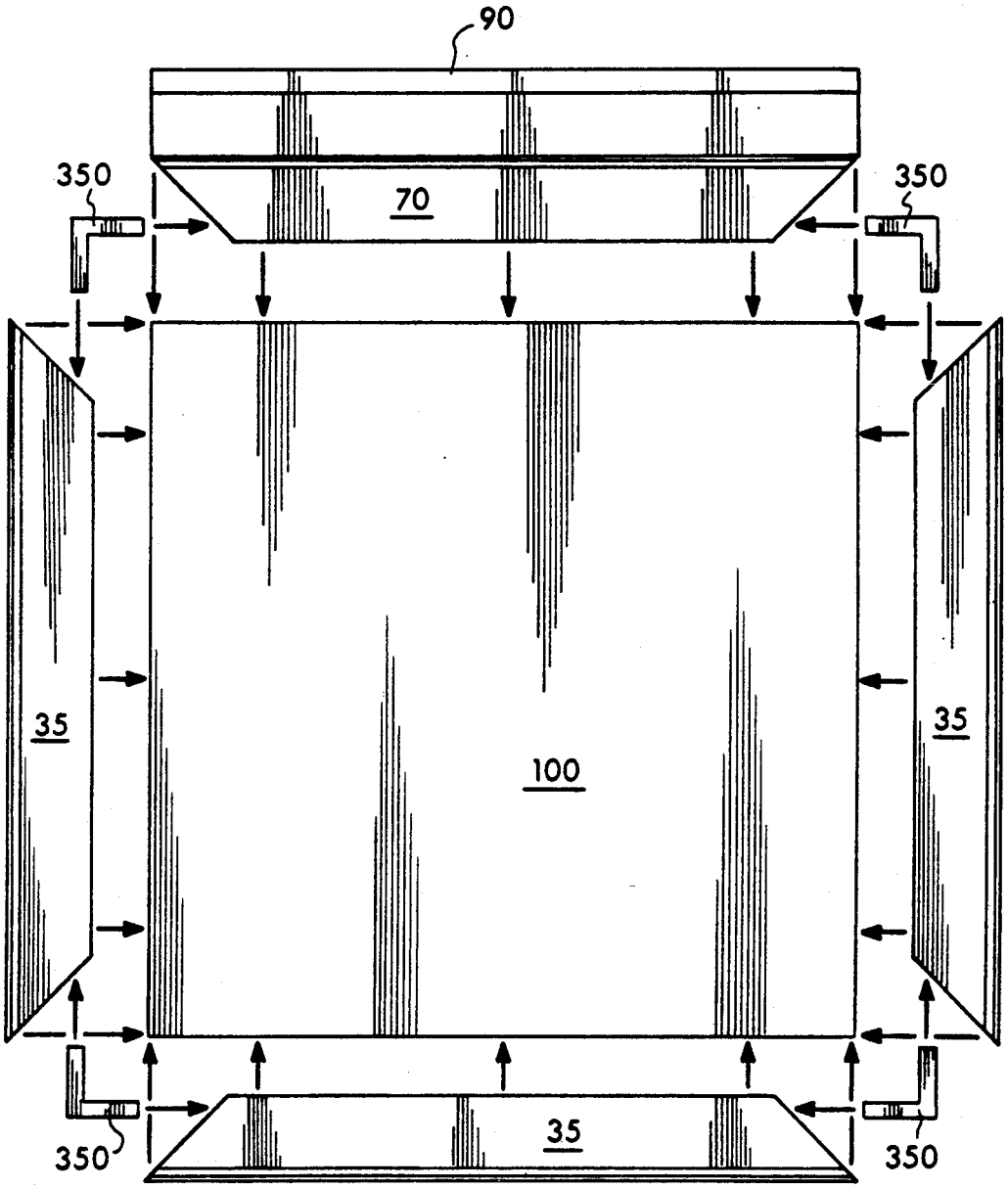
FIG. 6 is an exploded front view of an architectural panel with four edge brackets and corner pieces.
Figure 7:
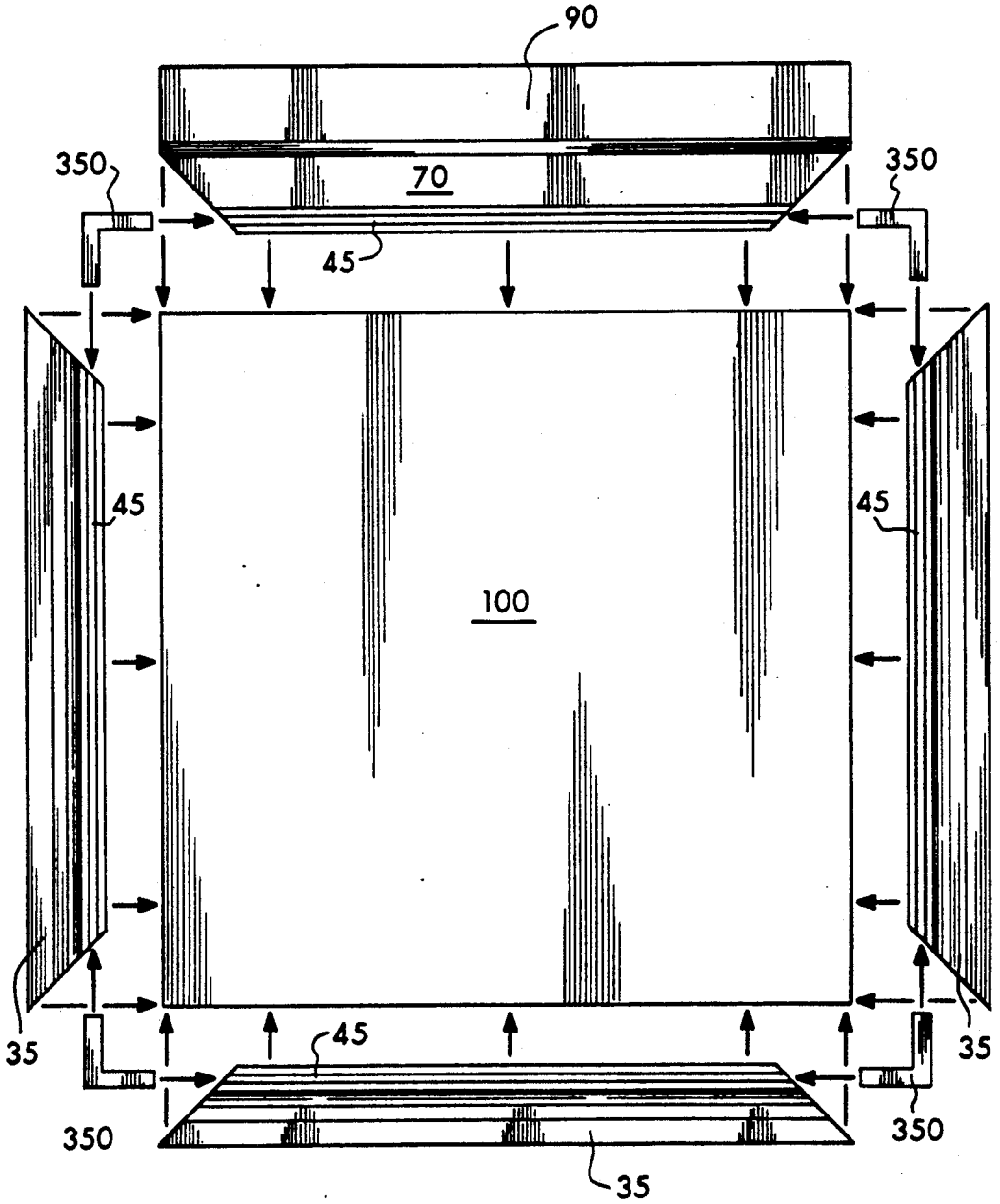
FIG. 7 is an exploded rear view corresponding to FIG. 6.

Second, the ends of the tracks 45 on adjacent panel brackets 70, 35 and 45 are typically mitered at a 45 degree angle, as shown in FIGS. 6 and 7. An L-shaped corner piece 350 can be secured to the adjacent tracks during assembly to maintain proper alignment and orthogonality of the corner. FIG. 6 provides an exploded front view of an architectural panel 100 with a top panel bracket 70, a bottom panel bracket and two side panel brackets 35 showing the manner in which four corner pieces 350 would be installed. FIG. 7 provides a corresponding exploded rear view of the panel 100, panel brackets 70 and 35, and the corner pieces 350.

It is to be expressly understood that the claimed invention is not to be limited to the description of the preferred embodiment but encompasses other modifications and alterations within the scope and spirit of the inventive concept and as described in the following claims.

I claim:

1. A fastening bracket for attaching an architectural panel (having a front surface, a rear surface, and a plurality of peripheral edges with a groove extending along at least one of said peripheral edges) to a support flange secured to a building structure in a predetermined direction, said bracket comprising:

a front face adapted to extend along said rear surface of said panel adjacent to one of said peripheral edges;

a flange extending from said front face adapted for insertion into said groove extending along said peripheral edge of said panel;

a track extending parallel to said peripheral edge, having an opening facing said building structure;

a channel with an opening extending parallel and adjacent to said peripheral edge, adapted for insertion of said support flange into said channel;

a pair of opposed flexible wipers extending along the interior of said channel on either side of said channel opening adapted to inwardly deflect as said support flange is inserted into said channel; and a pair of opposed guides extending along the interior of said channel on either side of said channel opening with a predetermined spacing between said guides adapted to guide insertion of said support flange into said channel.

2. The fastening system of claim 1 wherein said channel has a U-shaped cross-section.

3. The fastening system of claim 1 wherein said guides are made of plastic.

4. A fastening system for attaching a substantially rectangular architectural panel (having a front surface, a rear surface, a top edge, a bottom edge and two lateral edges, with a groove extending along said edges) to a building structure, said fastening system comprising:

a top panel bracket having:

(a) a front face adapted to extend along said rear surface of said panel adjacent to said top edge of said panel;

(b) a panel-gripping flange extending from said front face adapted for insertion into said groove extending along said top edge of said panel;

(c) a support member for securing said top panel bracket to said building structure; and (d) a substantially vertical flange extending upward at a predetermined spacing from said building structure;

two vertical mounting brackets, each adapted to be secured to said building structure in a substantially vertical orientation such that the horizontal distance between said vertical mounting brackets is approximately equal to the width of said panel, with two opposing flanges extending laterally outward from said bracket at a predetermined spacing from said building structure;

two side panel brackets, each having:

(a) a front face adapted to extend along said rear surface of said panel adjacent to one of said side edges of said panel;

(b) a panel-gripping flange extending from said front face adapted for insertion into said groove extending along said side edge of said panel; and (c) a channel with an opening extending parallel and adjacent to said side edge, adapted for insertion of one of said vertical mounting bracket flanges into said channel; and a bottom panel bracket having:

(a) a front face adapted to extend along said rear surface of said panel adjacent to said bottom edge of said panel;

(b) a panel-gripping flange extending from said front face adapted for insertion into said groove extending along said bottom edge of said panel; and (c) a channel with an opening extending parallel and adjacent to said bottom edge, adapted to receive the vertical flange extending upward from the top bracket of the panel below.

5. The fastening system of claim 4 wherein said channels of said side and bottom panel brackets each further comprises a pair of opposed flexible wipers extending along the interior of said channel on either side of said channel opening adapted to inwardly deflect as said flange is inserted into said channel.

6. The fastening system of claim 4 wherein said channels of said side and bottom panel brackets each further comprises a pair of opposed guides extending along the interior of said channel on either side of said channel opening with a predetermined spacing between said guides adapted to guide insertion of said flange into said channel.

7. The fastening system of claim 4 wherein said channel has a U-shaped cross-section.

8. The fastening system of claim 4 wherein said guides are made of plastic.

9. The fastening system of claim 4 wherein a plurality of said panel brackets each further comprises a track extending parallel to said panel edge, having an opening facing said building structure.

10. The fastening system of claim 9 further comprising a stiffener adapted to be attached across said rear face of said panel by means of a plurality of bolts having heads slidably retained in said tracks.

11. The fastening system of claim 9 wherein said tracks on adjacent panel brackets meet to form a corner, and wherein said fastening system further comprises a substantially L-shaped corner piece secured to said tracks on adjacent panel brackets to maintain orthogonality of said corner.

12. A fastening system for attaching a substantially rectangular architectural panel (having a front surface, a rear surface, a top edge, a bottom edge and two lateral edges. with a groove extending along said edges) to a building structure, said fastening system comprising:

a top panel bracket having:

(a) a front face adapted to extend along said rear surface of said panel adjacent to said top edge of said panel;

(b) a panel-gripping flange means extending from said front face adapted for insertion into said groove extending along said top edge of said panel;

(c) a support member for securing said top panel bracket to said building structure; and (d) a substantially vertical flange extending upward at a predetermined spacing from said building structure;

two vertical mounting brackets, each adapted to be secured to said building structure in a substantially vertical orientation such that the horizontal distance between said vertical mounting brackets is approximately equal to the width of said panel, with two opposing flanges extending laterally outward from said bracket at a predetermined spacing from said building structure;

two side panel brackets, each having:

(a) a front face adapted to extend along said rear surface of said panel adjacent to one of said side edges of said panel;

(b) a panel-gripping flange extending from said front face adapted for insertion into said groove extending along said side edge of said panel; and (c) a channel with an opening extending parallel and adjacent to said side edge, adapted for insertion of one of said vertical mounting bracket flanges into said channel;

(d) a pair of opposed flexible wipers extending along the interior of said channel on either side of said channel opening adapted to inwardly deflect as said flange is inserted into said channel; and (e) a pair of opposed guides extending along the interior of said channel on either side of said channel opening with a predetermined spacing between said guides adapted to guide insertion of said flange into said channel; and a bottom panel bracket having:

(a) a front face adapted to extend along said rear surface of said panel adjacent to said bottom edge of said panel;

(b) a panel-gripping flange extending from said front face adapted for insertion into said groove extending along said bottom edge of said panel; and (c) a channel with an opening extending parallel and adjacent to said bottom edge, adapted to receive the vertical flange extending upward from the top bracket of the panel below;

(d) a pair of opposed flexible wipers extending along the interior of said channel on either side of said channel opening adapted to inwardly deflect as said flange is inserted into said channel; and (e) a pair of opposed guides extending along the interior of said channel on either side of said channel opening with a predetermined spacing between said guides adapted to guide insertion of said flange into said channel.

13. The fastening system of claim 12 wherein a plurality of said panel brackets each further comprises a track extending parallel to said panel edge, having an opening facing said building structure.

14. The fastening system of claim 13 further comprising a stiffener adapted to be attached across said rear face of said panel by means of a plurality of bolts having heads slidably retained in said tracks.

15. The fastening system of claim 13 wherein said tracks on adjacent panel brackets meet to form a corner, and wherein said fastening system further comprises a substantially L-shaped corner piece secured to said tracks on adjacent panel brackets to maintain orthogonality of said corner.

* * * * *